US010991324B2

(12) United States Patent
Gao et al.

(10) Patent No.: US 10,991,324 B2
(45) Date of Patent: Apr. 27, 2021

(54) OVERDRIVE METHOD AND DEVICE, CONTROLLER, DISPLAY APPARATUS, AND STORAGE MEDIUM

(71) Applicants: Beijing BOE Display Technology Co., Ltd., Beijing (CN); BOE Technology Group Co., Ltd., Beijing (CN)

(72) Inventors: Yujie Gao, Beijing (CN); Zhihua Sun, Beijing (CN); Shulin Yao, Beijing (CN); Yinlong Zhang, Beijing (CN); Wenpeng Ma, Beijing (CN); Tong Lu, Beijing (CN); Pengfei Hu, Beijing (CN); Ning Zhang, Beijing (CN)

(73) Assignees: BEIJING BOE DISPLAY TECHNOLOGY CO., LTD., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/684,658

(22) Filed: Nov. 15, 2019

(65) Prior Publication Data

US 2020/0265791 A1 Aug. 20, 2020

(30) Foreign Application Priority Data

Feb. 18, 2019 (CN) ..... 201910123422.0

(51) Int. Cl.
*G09G 3/36* (2006.01)

(52) U.S. Cl.
CPC ..... *G09G 3/3607* (2013.01); *G09G 3/3696* (2013.01); *G09G 2310/027* (2013.01)

(58) Field of Classification Search
CPC ..... G09G 3/3607; G09G 3/3696; G09G 2310/027
See application file for complete search history.

(56) References Cited

U.S. PATENT DOCUMENTS 8,698,853 B2 * 4/2014 Kim ..... G09G 3/3648 345/690
8,699,803 B2 * 4/2014 Katayama ..... H04N 19/124 382/233
8,723,778 B2 * 5/2014 De Greef ..... G09G 3/3611 345/100

(Continued)

FOREIGN PATENT DOCUMENTS

CN 101197122 A 6/2008
CN 102820015 A 12/2012

(Continued)

*Primary Examiner* — Nitin Patel
*Assistant Examiner* — Robert M Stone
(74) *Attorney, Agent, or Firm* — Fay Sharpe LLP

(57) ABSTRACT

An overdrive method and device, a controller, a display apparatus, and a storage medium is provided. The method includes: acquiring a first grayscale value and a second grayscale value, the first grayscale value being a grayscale value of a first image displayed by a target sub-pixel and the second grayscale value being a grayscale of a second image to be displayed by the target sub-pixel; acquiring a hold duration that the target sub-pixel holds the first grayscale value in response to the first grayscale value being not equal to the second grayscale value; determining a target overdrive compensation voltage according to the first grayscale value, the second grayscale value, and the hold duration; and applying an overdrive pixel voltage to the target sub-pixel in response to the target sub-pixel displaying the second image, the overdrive pixel voltage being obtained according to the target overdrive compensation voltage.

17 Claims, 6 Drawing Sheets

(56) References Cited

U.S. PATENT DOCUMENTS 9,053,674 B2 * 6/2015 Chen ..... G09G 3/3611
9,557,850 B2 * 1/2017 Wang ..... G06F 3/0446
9,672,780 B2 * 6/2017 Lee ..... G09G 3/3648
2004/0246224 A1 * 12/2004 Tsai ..... G09G 3/3696 345/100
2005/0068343 A1 * 3/2005 Pan ..... G09G 3/3648 345/690
2006/0033727 A1 2/2006 Hsu et al.
2006/0256038 A1 * 11/2006 Whight ..... G09G 3/3648 345/55
2007/0018934 A1 * 1/2007 Kim ..... G09G 3/2025 345/98
2007/0285366 A1 * 12/2007 Ha ..... G09G 3/3648 345/87
2007/0285371 A1 * 12/2007 Nam ..... G06F 3/1462 345/98
2008/0158119 A1 * 7/2008 Park ..... G09G 3/3648 345/87
2009/0147029 A1 * 6/2009 Hung ..... G09G 3/3611 345/690
2009/0153743 A1 * 6/2009 Arashima ..... H04N 5/145 348/699
2009/0195564 A1 8/2009 Jen et al.
2010/0091042 A1 * 4/2010 Inoue ..... G09G 3/2025 345/690
2010/0302287 A1 * 12/2010 Katayama ..... G09G 3/3648 345/690
2014/0104262 A1 * 4/2014 Miyake ..... G09G 3/3696 345/212
2015/0325217 A1 * 11/2015 Lee ..... G09G 3/3648 345/545
2016/0063933 A1 * 3/2016 Kobayashi ..... G09G 3/3614 345/691
2016/0104444 A1 * 4/2016 Miyata ..... G09G 3/3413 345/205
2016/0187698 A1 * 6/2016 Kobayashi ..... G02F 1/133528 349/33
2016/0284258 A1 * 9/2016 Brunner ..... G02F 1/1309
2016/0379576 A1 * 12/2016 Shin ..... G09G 3/3685 345/694
2017/0287375 A1 * 10/2017 Ukai ..... G09G 3/025

FOREIGN PATENT DOCUMENTS

CN 105074809 A 11/2015
CN 108806623 A 11/2018

* cited by examiner

OVERDRIVE METHOD AND DEVICE, CONTROLLER, DISPLAY APPARATUS, AND STORAGE MEDIUM

This application claims priority to Chinese Patent Application No. 201910123422.0, filed on Feb. 18, 2019 and entitled "OVERDRIVE METHOD AND DEVICE, CONTROLLER AND DISPLAY APPARATUS OF LIQUID CRYSTAL DISPLAY PANEL", the entire contents of which are incorporated herein by reference.

TECHNICAL FIELD

The present disclosure relates to an overdrive method and device, a controller, a display apparatus, and a storage medium.

BACKGROUND

In the field of liquid crystal displays, a display apparatus includes a liquid crystal display panel and a timing controller. The liquid crystal display panel includes a plurality of sub-pixels, each of which includes liquid crystal molecules, and the liquid crystal molecules may be deflected under the driving of a voltage applied by the timing controller and change the light transmittance of the liquid crystal display panel, and thus a screen display is realized.

SUMMARY

The embodiments of the present disclosure provide an overdrive method and device, a controller, a display apparatus, and a storage medium. The technical solutions are as follows.

In an aspect, there is provided an overdrive method, including:

acquiring a first grayscale value and a second grayscale value, the first grayscale value being a grayscale value of a first image displayed by a target sub-pixel and the second grayscale value being a grayscale of a second image to be displayed by the target sub-pixel;

acquiring a hold duration that the target sub-pixel holds the first grayscale value when the first grayscale value is not equal to the second grayscale value;

determining a target overdrive compensation voltage according to the first grayscale value, the second grayscale value, and the hold duration; and applying an overdrive pixel voltage to the target sub-pixel in response to the target sub-pixel displaying the second image, the overdrive pixel voltage being obtained according to the target overdrive compensation voltage.

Optionally, the target overdrive compensation voltage is positively correlated with the hold duration.

Optionally, determining the target overdrive compensation voltage according to the first grayscale value, the second grayscale value, and the hold duration includes:

calculating the target overdrive compensation voltage by a target formula according to the first grayscale value, the second grayscale value, and the hold duration, the target formula including:

$$\Delta L = \frac{t^{\alpha}}{H} \times \Delta L_{origin};$$

wherein ΔL denotes the target overdrive compensation voltage; t denotes the hold duration; α denotes a tuning coefficient of liquid crystal molecules in the target sub-pixel; H denotes a row scanning duration of a liquid crystal display panel where the target sub-pixel is located; ΔLorigin denotes an original overdrive compensation voltage obtained by querying a target correspondence relationship according to the first grayscale value and the second grayscale value, wherein the target correspondence relationship is used to record plural groups of two grayscale values that are adjacent in time sequence and the corresponding overdrive compensation voltages.

Optionally, determining the target overdrive compensation voltage according to the first grayscale value, the second grayscale value, and the hold duration includes:

determining the target overdrive compensation voltage according to the first grayscale value, the second grayscale value, and the hold duration in response to the hold duration being longer than a single frame display duration, wherein the single frame display duration is a duration that the liquid crystal display panel where the target sub-pixel is located displays each frame of an image.

Optionally, the overdrive method further includes:

obtaining the original overdrive compensation voltage by querying the target correspondence relationship according to the first grayscale value and the second grayscale value in response to the hold duration being equal to or shorter than a signal frame display duration, wherein the target correspondence relationship is used to record plural groups of two grayscale values that are adjacent in time sequence and the corresponding overdrive compensation voltages; and determining the original overdrive compensation voltage as the target overdrive compensation voltage.

Optionally, applying the overdrive pixel voltage to the target sub-pixel includes:

applying the overdrive pixel voltage to the target sub-pixel within a target duration, wherein the target duration is shorter than the single frame display duration and the single frame display duration is a duration that the liquid crystal display panel, where the target sub-pixel is located, displays each frame of an image.

Optionally, the target duration is positively correlated with the hold duration.

In another aspect, there is provided an overdrive device, including:

a first acquiring module, configured to acquire a first grayscale value and a second grayscale value, the first grayscale value being a grayscale value of a first image displayed by a target sub-pixel and the second grayscale value being a grayscale of a second image to be displayed by the target sub-pixel;

a second acquiring module, configured to acquire a hold duration that the target sub-pixel holds the first grayscale value in response to the first grayscale value being not equal to the second grayscale value;

a first determining module, configured to determine a target overdrive compensation voltage according to the first grayscale value, the second grayscale value, and the hold duration; and an applying module, configured to apply an overdrive pixel voltage to the target sub-pixel in response to the target sub-pixel displaying the second image, the overdrive pixel voltage being obtained according to the target overdrive compensation voltage.

Optionally, the target overdrive compensation voltage is positively correlated with the hold duration.

Optionally, the first determining module is configured to calculate the target overdrive compensation voltage by a target formula according to the first grayscale value, the second grayscale value, and the hold duration, the target formula including:

$$\Delta L = \frac{t^{\alpha}}{H} \times \Delta L_{origin};$$

wherein ΔL denotes the target overdrive compensation voltage; t denotes the hold duration; α denotes a tuning coefficient of liquid crystal molecules in the target sub-pixel; H denotes a row scanning duration of a liquid crystal display panel where the target sub-pixel is located; ΔLorigin denotes an original overdrive compensation voltage obtained by querying a target correspondence relationship according to the first grayscale value and the second grayscale value, wherein the target correspondence relationship is used to record plural groups of two grayscale values that are adjacent in time sequence and the corresponding overdrive compensation voltages.

Optionally, the first determining module is configured to determine the target overdrive compensation voltage according to the first grayscale value, the second grayscale value, and the hold duration in response to that the hold duration is longer than a single frame display duration, wherein the single frame display duration is a duration that the liquid crystal display panel where the target sub-pixel is located displays each frame of an image.

Optionally, the overdrive device further includes: a second determining module, configured to:

obtain the original overdrive compensation voltage by querying the target correspondence relationship according to the first grayscale value and the second grayscale value in response to the hold duration being equal to or shorter than the signal frame display duration, wherein the target correspondence relationship is used to record plural groups of two grayscale values that are adjacent in time sequence and the corresponding overdrive compensation voltages; and determine the original overdrive compensation voltage as the target overdrive compensation voltage.

Optionally, the applying module is configured to apply the overdrive pixel voltage to the target sub-pixel within a target duration, wherein the target duration is shorter than the single frame display duration, and the single frame display duration is a duration that the liquid crystal display panel, where the target sub-pixel is located, displays each frame of an image.

Optionally, the target duration is positively correlated with the hold duration.

In yet another aspect, there is provided a controller of a liquid crystal display panel including an overdrive device, the overdrive device including:

a first acquiring module, configured to acquire a first grayscale value and a second grayscale value, the first grayscale value being a grayscale value of a first image displayed by a target sub-pixel and the second grayscale value being a grayscale of a second image to be displayed by the target sub-pixel;

a second acquiring module, configured to acquire a hold duration that the target sub-pixel holds the first grayscale value in response to the first grayscale value being not equal to the second grayscale value;

a first determining module, configured to determine a target overdrive compensation voltage according to the first grayscale value, the second grayscale value, and the hold duration; and an applying module, configured to apply an overdrive pixel voltage to the target sub-pixel in response to the target sub-pixel displaying the second image, the overdrive pixel voltage being obtained according to the target overdrive compensation voltage.

Optionally, the target duration is positively correlated with the hold duration.

Optionally, the first determining module is configured to calculate the target overdrive compensation voltage by a target formula according to the first grayscale value, the second grayscale value, and the hold duration, the target formula including:

$$\Delta L = \frac{t^{\alpha}}{H} \times \Delta L_{origin};$$

wherein ΔL denotes the target overdrive compensation voltage; t denotes the hold duration; α denotes a tuning coefficient of liquid crystal molecules in the target sub-pixel; H denotes a row scanning duration of a liquid crystal display panel where the target sub-pixel is located; ΔLorigin denotes an original overdrive compensation voltage obtained by querying a target correspondence relationship according to the first grayscale value and the second grayscale value, wherein the target correspondence relationship is used to record plural groups of two grayscale values that are adjacent in time sequence and the corresponding overdrive compensation voltages.

Optionally, the first determining module is configured to determine the target overdrive compensation voltage according to the first grayscale value, the second grayscale value, and the hold duration in response to that the hold duration is longer than a single frame display duration, wherein the single frame display duration is a duration that the liquid crystal display panel where the target sub-pixel is located displays each frame of an image.

Optionally, the overdrive device further includes: a second determining module, configured to:

obtain the original overdrive compensation voltage by querying the target correspondence relationship according to the first grayscale value and the second grayscale value in response to the hold duration being equal to or shorter than the signal frame display duration, wherein the target correspondence relationship is used to record plural groups of two grayscale values that are adjacent in time sequence and the corresponding overdrive compensation voltages; and determine the original overdrive compensation voltage as the target overdrive compensation voltage.

Optionally, the applying module is configured to apply the overdrive pixel voltage to the target sub-pixel within a target duration, wherein the target duration is shorter than the single frame display duration that is a duration that the liquid crystal display panel, where the target sub-pixel is located, displays each frame of an image.

Optionally, the target duration is positively correlated with the hold duration.

In still yet another aspect, there is provided a display apparatus, including a liquid crystal display panel and a controller, wherein the controller is the controller in the above aspect and configured to drive the liquid crystal display panel to display images.

In still yet another aspect, there is provided a storage medium in which an instruction is stored, wherein when the instruction runs at a processing component, the processing component is actuated to execute the overdrive method the above aspect.

BRIEF DESCRIPTION OF THE DRAWINGS

In order to describe embodiments of the present disclosure more clearly, drawings used in the descriptions of the embodiments will be briefly described below. Apparently, the drawings in the following descriptions are merely some embodiments of the present disclosure, and a person of ordinary skill in the art may also derive other drawings from the drawings without creative efforts.

Figure 1:
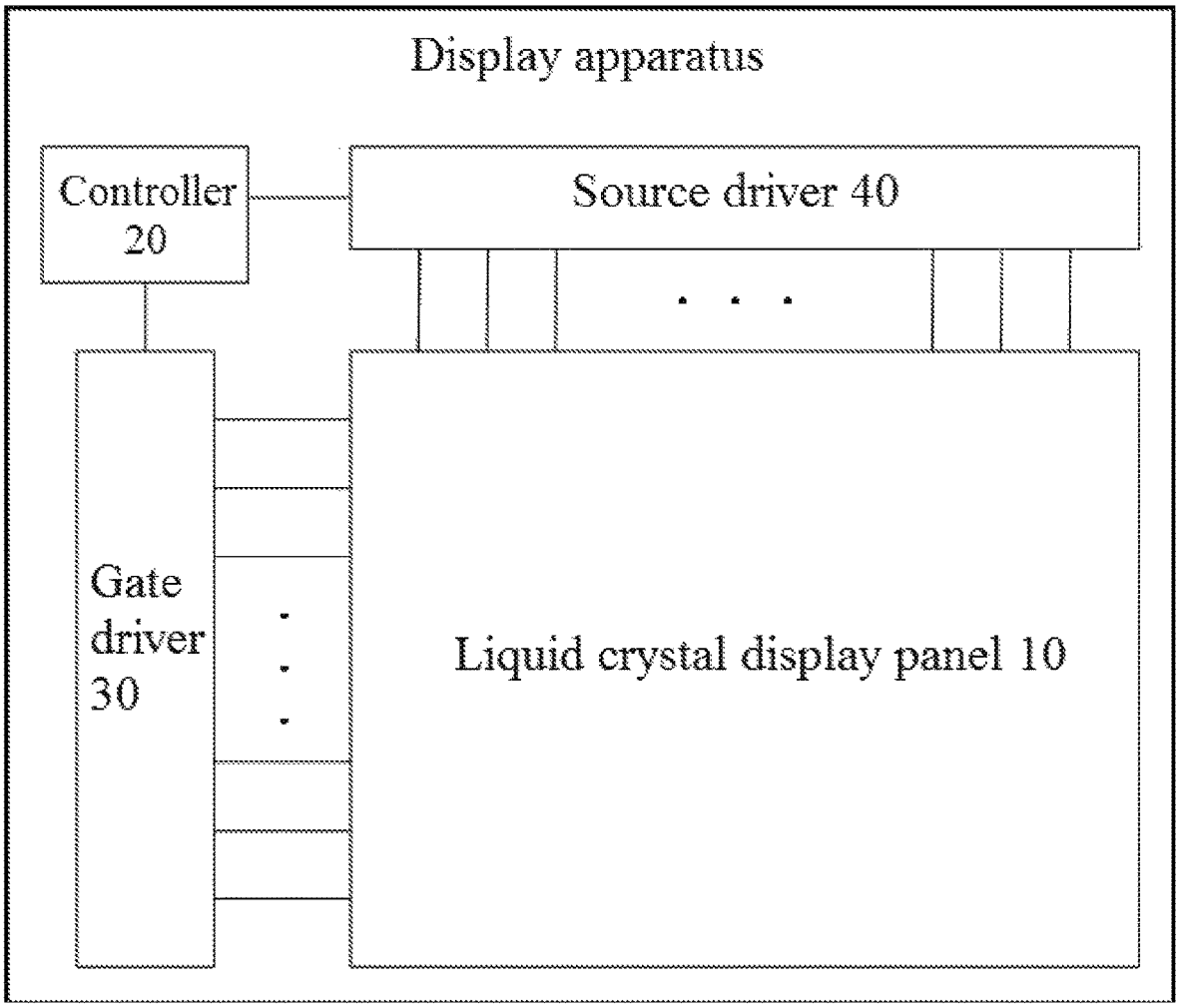
FIG. 1 is a schematic diagram of an application environment of an overdrive method according to an embodiment of the present disclosure.

The drawings herein are incorporated in the specification and constitute a part of the specification. They show the embodiments consistent with the present disclosure and are used to explain the principles of the present disclosure in conjunction with the specification.

DETAILED DESCRIPTION

In order to describe the principles, technical solutions and advantages of the present more clearly, the present disclosure will be further described in detail below in combination with drawings. Apparently, the described embodiments are merely some embodiments, rather than all embodiments, of the present disclosure. Based on the embodiments of the present disclosure, all other embodiments derived by a person of ordinary skill in the art without creative efforts shall fall within the protection scope of the present disclosure.

In the field of liquid crystal display, a display apparatus includes a liquid crystal display panel and a timing controller. Each sub-pixel of the liquid crystal display panel includes liquid crystal molecules and the liquid crystal molecules may be deflected under the driving of a voltage applied by the timing controller, thereby enabling the liquid crystal display to realize the screen display. However, due to viscosity of the liquid crystal molecules, it takes a period of time to deflect the liquid crystal molecules to a desired posture under the driving of the voltage. The period of time may be referred to as a response time of the liquid crystal molecules. If the response time of the liquid crystal molecules is too long, the liquid crystal display panel may have motion blur, which affects the display effect. In view of this, an overdrive technology is introduced to a plurality of liquid crystal display panels to shorten the response time of liquid crystal molecules.

In the overdrive technology, for each sub-pixel in the liquid crystal display panel, when an image is displayed, the timing controller can determine an overdrive compensation voltage of the sub-pixel according to a grayscale value of the image, and obtain a pixel voltage actually required to be applied to the sub-pixel (also referred to as an overdrive pixel voltage) by adding the pixel voltage required to be applied to the sub-pixel for displaying the image and the overdrive compensation voltage. Then, the overdrive pixel voltage is applied to the sub-pixel, so that liquid crystal molecules in the sub-pixel can be deflected to the desired posture in a short time.

As known by the inventor, the timing controller may obtain, for each sub-pixel, the above overdrive compensation voltage according to the grayscale value of the image displayed by the sub-pixel and the grayscale value of the image to be displayed by the sub-pixel. However, for a liquid crystal molecule having a relatively high viscosity, the overdrive compensation voltage as obtained in the above manner can hardly ensure that the liquid crystal molecules are deflected to the desired posture in a short time, which causes the liquid crystal display panel to have a poor display effect.

Please refer to FIG. 1, which is schematic diagram showing an application environment of an overdrive method according to an embodiment of the present disclosure. As shown in FIG. 1, the overdrive method is applied in a display apparatus and the display apparatus may be a liquid crystal display apparatus. The display apparatus includes a liquid crystal display panel 10 and a controller 20, and the controller 20 is connected to the liquid crystal display panel 10, and is configured to drive the liquid crystal display panel 10 to display images. The controller 20 may apply an overdrive pixel voltage to sub-pixels of the liquid crystal display panel 10, in order to drive the sub-pixels, in a manner of overdrive, to display images, and thus to drive the liquid crystal display panel 10 to display images.

Optionally, as shown in FIG. 1, the display apparatus further includes a gate driver 30 and a source driver 40, the gate driver 30 and the source driver 40 are respectively connected to the controller 20, and the gate driver 30 and the source driver 40 are respectively connected to the liquid crystal display panel 10. Thus, the controller 20 is connected to the liquid crystal display panel 10 by the gate driver 30 and the source driver 40, and is configured to drive the liquid crystal display panel 10 to display images by the gate driver 30 and the source driver 40.

The above controller 20 may be a timing controller, for example, a timer control register integrated circuit (TCON IC), and both the gate driver 30 and source driver 40 may be a chip.

Figure 2:
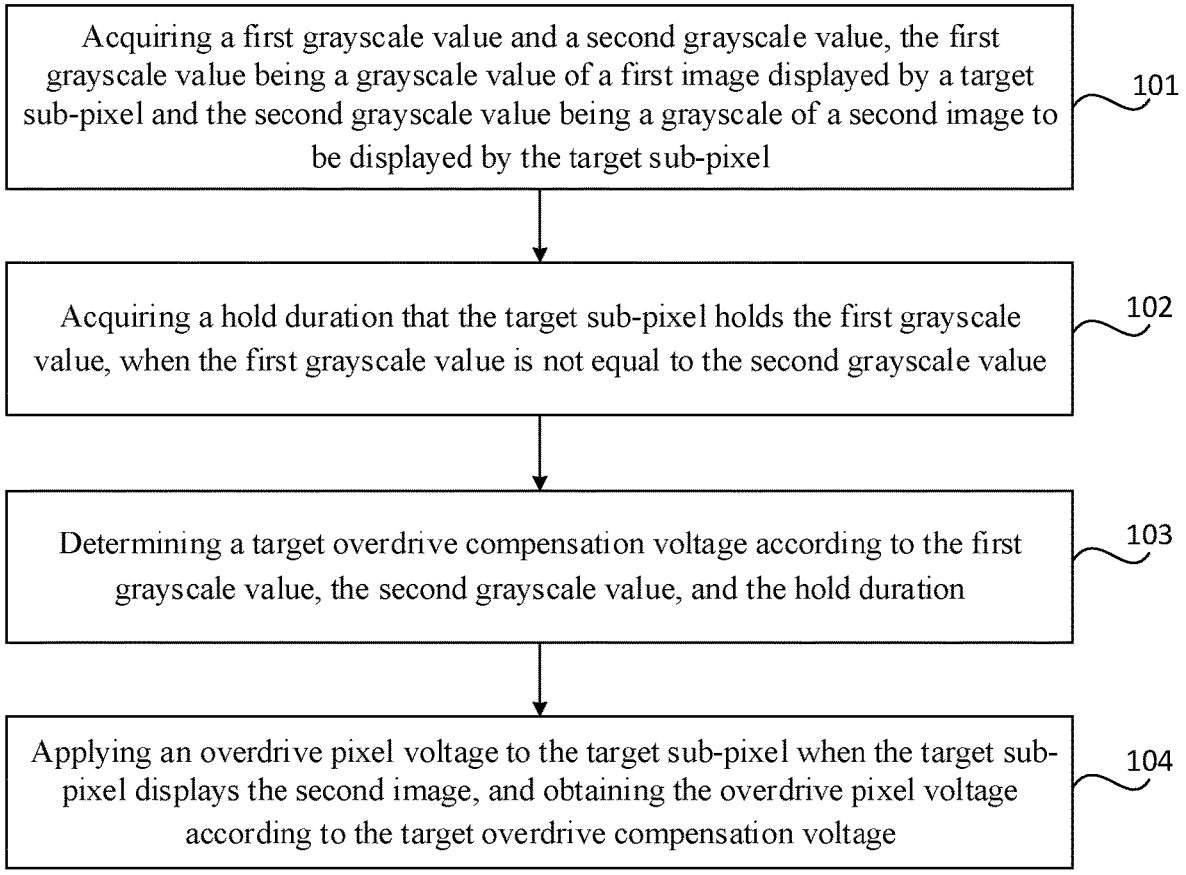
FIG. 2 is a flowchart of an overdrive method according to an embodiment of the present disclosure.

Please refer to FIG. 2, which is a flowchart showing an overdrive method according to an embodiment of the present disclosure. The method is applied to the application environment shown in FIG. 1 and may be executed by the controller in the application environment shown in FIG. 1. As shown in FIG. 2, the overdrive method includes following steps.

In step 101, a first grayscale value and a second grayscale value are acquired, the first grayscale value being a grayscale value of a first image displayed by a target sub-pixel and the second grayscale value being a grayscale of a second image to be displayed by the target sub-pixel.

In step 102, a hold duration that the target sub-pixel holds the first grayscale value is acquired, when the first grayscale value is not equal to the second grayscale value.

In step 103, a target overdrive compensation voltage is determined according to the first grayscale value, the second grayscale value, and the hold duration.

In step 104, an overdrive pixel voltage is applied to the target sub-pixel when the target sub-pixel displays the second image, and the overdrive pixel voltage is obtained according to the target overdrive compensation voltage.

In summary, in the overdrive method according to the embodiment of the present disclosure, the controller may determine the target overdrive compensation voltage according to the first grayscale value of the first image displayed by the target sub-pixel, the second grayscale value of the second image to be displayed by the target sub-pixel, and the hold duration that the target sub-pixel holds the first grayscale value, and the controller may also apply the overdrive pixel voltage, which is obtained according to the target overdrive compensation voltage, to the target sub-pixel, when the target sub-pixel displays the second image. Since the hold duration which is a parameter that causes the viscosity of the liquid crystal molecule to be enhanced and that the target sub-pixel holds the first grayscale value is taken into consideration during the process of determining the overdrive compensation voltage, applying the overdrive pixel voltage which is obtained according to the target overdrive compensation voltage to the target sub-pixel may help to shorten the response time of the liquid crystal molecules, deflect the liquid crystal molecules to a desired posture in a short time, and improve the display effect of the liquid crystal display panel.

Figure 3:
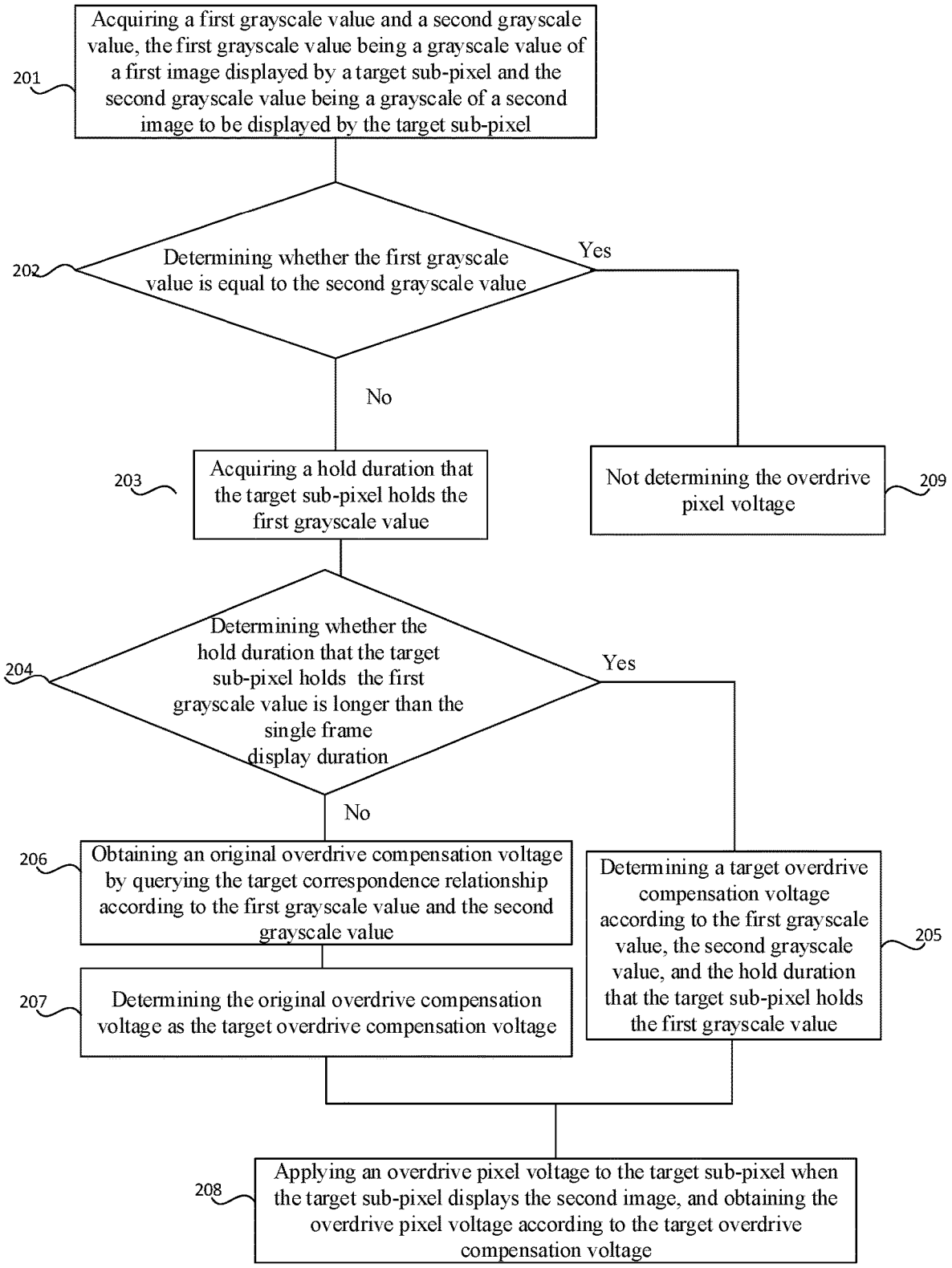
FIG. 3 is a flowchart of another overdrive method according to an embodiment of the present disclosure.

Please refer to FIG. 3, which is a flowchart showing another overdrive method according to an embodiment of the present disclosure, and the method is applied to the application environment shown in FIG. 1 and may be executed by the controller in the application environment shown in FIG. 1. The liquid crystal display panel includes a plurality of sub-pixels, and the controller may drive any one of the sub-pixels to display images according to the method provided in this embodiment. In this embodiment, the controller driving a sub-pixel (that is, a target sub-pixel described below) on the liquid crystal display panel is taken as an example for description. As shown in FIG. 3, the overdrive method includes following steps.

In step 201, a first grayscale value and a second grayscale value are acquired, the first grayscale value being a grayscale value of a first image displayed by a target sub-pixel and the second grayscale value being a grayscale of a second image to be displayed by the target sub-pixel.

The first grayscale value and the second grayscale value are two grayscale values adjacent in time sequence.

Optionally, for each frame of image that the liquid crystal display panel needs to display, the controller may store grayscale values of images displayed by each of the sub-pixels when the liquid crystal display panel displays each frame of the image. The controller may acquire the grayscale value of the first image (that is, the first grayscale value) displayed by the target sub-pixel and the grayscale value of the second image (that is, the second grayscale value) to be displayed by the target sub-pixel, from the grayscale values stored per se. For example, the first grayscale value acquired by the controller may be a1, and the second grayscale value may be a2.

In step 202, it is determined whether the first grayscale value is equal to the second grayscale value. A step 203 is executed if the first grayscale value is not equal to the second grayscale value. A step 209 is executed if the first grayscale value is equal to the second grayscale value.

Optionally, the controller may compare the first grayscale value with the second grayscale value to determine whether the first grayscale value is equal to the second grayscale value. For example, the controller compares the first grayscale value a1 with the second grayscale value a2 to determine whether the first grayscale value a1 is equal to the second grayscale value a2.

In step 203, a hold duration that the target sub-pixel holds the first grayscale value is acquired.

Optionally, during the process that the target sub-pixel holds the first grayscale value, the controller may acquire the frame refreshing number of the liquid crystal display panel (that is, the number of frames that the liquid crystal display panel refreshes the image, or the number of frames that the liquid crystal display panel displays the image) and the single frame display duration of the liquid crystal display panel. The product of the frame refreshing number and the single frame display duration is determined as the hold duration that the target sub-pixel holds the first grayscale value. The single frame display duration is a duration that the liquid crystal display panel, in which the target sub-pixel is located, displays each frame of an image. The single frame display duration is associated with the display system and the refresh rate of the liquid crystal display panel. For a fixed liquid crystal display panel, the single frame display duration is generally constant. For example, if the liquid crystal display panel displays 48 frames of images in one second, the single frame display duration is 1/48 second.

Alternatively, the controller may acquire the number of clock cycles for applying the first pixel voltage to the target sub-pixel and determine the duration of each clock cycle according to the operating frequency of the controller. Then, the controller determines the product of the number of clock cycles and the duration of the clock cycle as the hold duration that the target sub-pixel holds the first grayscale value. The first pixel voltage is a voltage enabling the target sub-pixel to hold the first grayscale value.

Alternatively, the controller may have a timer function. When the grayscale of the target sub-pixel is the first grayscale value, the controller starts timing. When the grayscale value of the target sub-pixel changes, the controller stops timing. Then, the controller determines the hold duration that the target sub-pixel holds the first grayscale value according to the time when the timing is started and the time when the timing is stopped.

It is easy to understand that the manner for acquiring the hold duration that the target sub-pixel holds the first grayscale value as provided by the embodiment of the present application is merely exemplary. There are various manners for the controller to determine the hold duration that the target sub-pixel holds the first grayscale value as long as the hold duration that the target sub-pixel holds the first grayscale value can be acquired. The manners are not limited in the embodiment of the present application.

In step 204, it is determined whether the hold duration that the target sub-pixel holds the first grayscale value is longer than the single frame display duration. A step 205 is executed when the hold duration is longer than the single frame display duration. A step 206 is executed when the hold duration is equal to or shorter than the single frame display duration.

Optionally, the controller may compare the hold duration that the target sub-pixel holds the first grayscale value with the single frame display duration to determine whether the hold duration is longer than the single frame display duration.

Optionally, Assume that the hold duration that the target sub-pixel holds the first grayscale value is t1 and the single frame display duration is T, the controller compares t1 with T to determine whether the hold duration t1 that the target sub-pixel holds the first grayscale value is longer than the single frame display duration T.

In step 205, a target overdrive compensation voltage is determined according to the first grayscale value, the second grayscale value, and the hold duration that the target sub-pixel holds the first grayscale value.

For any sub-pixel, the longer the time of maintaining a certain gray scale value, the stronger the viscosity of the liquid crystal molecules in the sub-pixel, and thus the greater overdrive compensation voltage for deflecting the liquid crystal molecules in the sub-pixel to the desired posture in a short time is required. Therefore, for any sub-pixel, the overdrive compensation voltage is positively correlated with the time of maintaining a certain gray scale value. Thus, for the target sub-pixel, the target overdrive compensation voltage is positively correlated with the hold duration that the target sub-pixel holds the first grayscale value.

Optionally, in the embodiment of the present application, determining the target overdrive compensation voltage by the controller according to the first grayscale value, the second grayscale value, and the hold duration that the target sub-pixel holds the first grayscale value may include that the controller calculates the target overdrive compensation voltage by a target formula according to the first grayscale value, the second grayscale value, and the hold duration that the target sub-pixel holds the first grayscale value. The target formula includes:

$$\Delta L = \frac{t^{\alpha}}{H} \times \Delta L_{origin};$$

where ΔL denotes the target overdrive compensation voltage; t denotes the hold duration that the target sub-pixel holds the first grayscale value; α denotes a tuning coefficient of the liquid crystal molecules in the target sub-pixel; H denotes a row scanning duration (that is, the duration for scanning a row of sub-pixels) of a liquid crystal display panel; $\Delta L_{origin}$ denotes an original overdrive compensation voltage obtained by querying a target correspondence relationship according to the first grayscale value and the second grayscale value. The target correspondence relationship is used to record plural groups of two grayscale values that are adjacent in time sequence and the corresponding overdrive compensation voltages, and the two grayscale values that are adjacent in the time sequence of a certain sub-pixel refer to two grayscale values of the sub-pixel when the liquid crystal display panel displays two frames of images that are adjacent in the time sequence. For the given liquid crystal display panels, the tuning coefficient α and the row scanning duration H are generally constant.

Optionally, the controller stores the target correspondence relationship that is used to record plural groups of two grayscale values that are adjacent in time sequence and the corresponding overdrive compensation voltages, and the controller may obtain the original overdrive compensation voltage $\Delta L_{origin}$ by querying the target correspondence relationship according to the first grayscale value and the second grayscale value. For example, the target correspondence relationship may be as shown in Table 1 below.

TABLE 1

| Group number | Grayscale value group | | Overdrive compensation voltage |
|---|---|---|---|
| 1 | a1 | a2 | $\Delta L_{origin}1$ |
| 2 | b1 | b2 | $\Delta L_{origin}2$ |
| 3 | c1 | c2 | $\Delta L_{origin}3$ |
| . . . | . . . | . . . | . . . |

As shown in Table 1, each grayscale value group includes two grayscale values adjacent in time sequence, and each grayscale value group corresponds to one overdrive compensation voltage. For example, the grayscale value group 1 includes two grayscale values a1 and a2 that are adjacent in time sequence, and the grayscale value group 1 corresponds to the overdrive compensation voltage $\Delta L_{origin}1$. The grayscale value group 2 includes two grayscale values b1 and b2 that are adjacent in time sequence, and the grayscale value group 2 corresponds to the overdrive compensation voltage $\Delta L_{origin}2$, and so forth.

It can be easily seen from the step 205 that the first grayscale value in the embodiment of the present disclosure is a1, and the second grayscale value is a2. Thus, the controller may determine that the original overdrive compensation voltage $\Delta L_{origin}$ is $\Delta\Delta L_{origin}1$ by querying the correspondence relationship shown in Table 1 according to the first grayscale value a1 and the second grayscale value a2.

In step 206, an original overdrive compensation voltage is obtained by querying the target correspondence relationship according to the first grayscale value and the second grayscale value.

The controller executes the step 206 when the controller determines in the above step 204 that the hold duration that the target sub-pixel holds the first grayscale value is equal to or shorter than the single frame display duration. For the implementation process of the step 206, it may refer to the process in which the controller obtains the original overdrive compensation voltage $\Delta L_{origin}$ in the above step 205, and will not be repeatedly described in this embodiment of the present disclosure.

In step 207, the original overdrive compensation voltage is determined as the target overdrive compensation voltage.

The controller may determine the original overdrive compensation voltage as the target overdrive compensation voltage. For example, the controller determines the original overdrive compensation voltage $\Delta L_{origin}1$ as the target overdrive compensation voltage.

In step 208, an overdrive pixel voltage is applied to the target sub-pixel when the target sub-pixel displays the second image, and the overdrive pixel voltage is obtained according to the target overdrive compensation voltage.

Optionally, the controller may determine the overdrive pixel voltage according to the target overdrive compensation voltage, and apply the overdrive pixel voltage to the target sub-pixel when the target sub-pixel displays the second image. Optionally, the controller may acquire the second pixel voltage of the target sub-pixel, and obtain the overdrive pixel voltage by adding the second pixel voltage to the target overdrive compensation voltage or by subtracting the second pixel voltage from the target overdrive compensation voltage. Certainly, the controller may determine the overdrive pixel voltage according to the target overdrive compensation voltage in other manners, which are not limited in the embodiment of the present disclosure. The second pixel voltage is a pixel voltage required to be applied for enabling the target sub-pixel to display the second image when the overdrive technology is not employed to drive the target sub-pixel to display the image.

Optionally, when the target sub-pixel displays the second image, the controller may apply the overdrive pixel voltage to the target sub-pixel within a target duration. The target duration is shorter than the single frame display duration and is positively correlated with the hold duration that the target sub-pixel holds the first grayscale value. For example, the controller, within the target duration, may control the target sub-pixel to be turned on by the gate driver, and transmit the overdrive pixel voltage to the target sub-pixel by the source driver.

Figure 4:
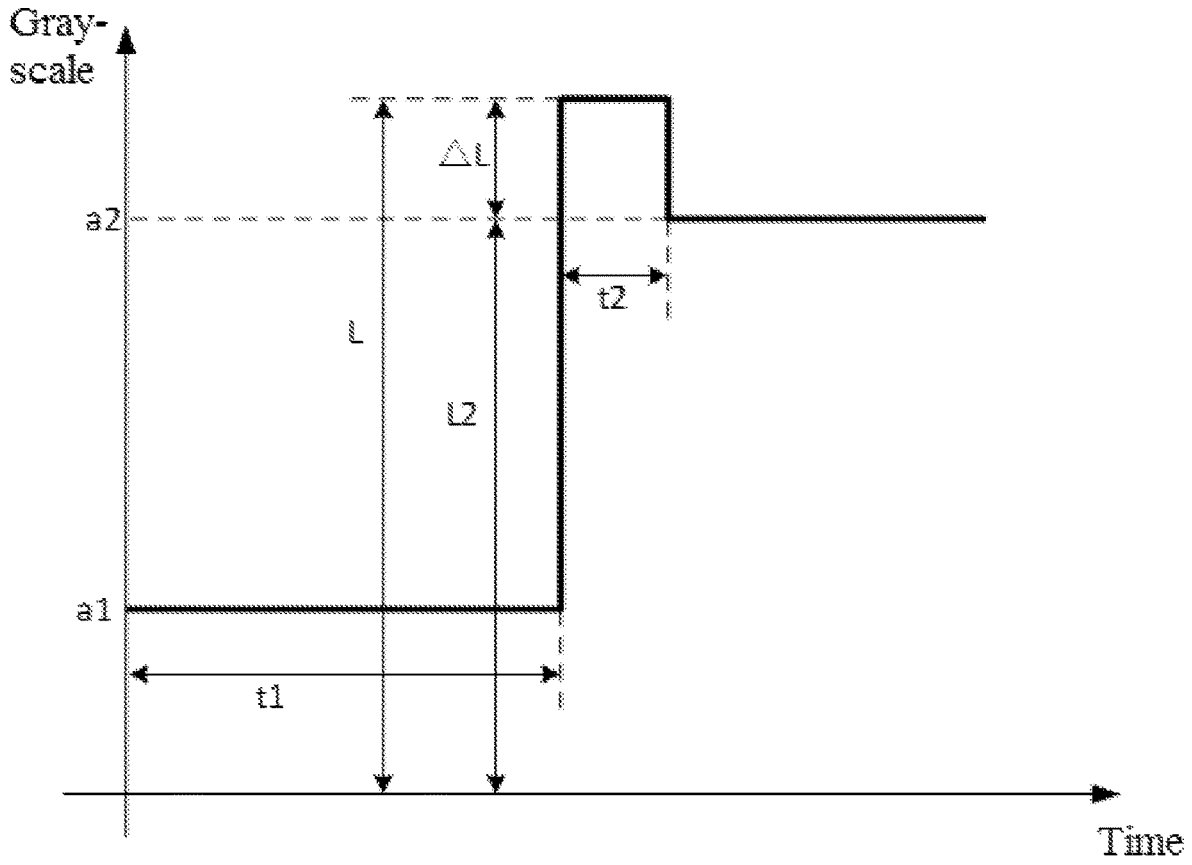
FIG. 4 is a schematic diagram of applying an overdrive pixel voltage to a target sub-pixel according to an embodiment of the present disclosure.

As shown in FIG. 4, which is a schematic diagram showing an overdrive pixel voltage is applied to a target sub-pixel according to an embodiment of the present disclosure, the hold duration that the target sub-pixel holds the first grayscale value is t1, the target duration t2 is shorter than the single frame display duration, and the overdrive pixel voltage L is equal to the sum of the target overdrive compensation voltage ΔL and the second pixel voltage L2. The controller may apply the overdrive pixel voltage L to the target sub-pixel within the target duration t2 so as to adjust the grayscale of the target sub-pixel from the first grayscale value a1 to the second grayscale value a2. After the grayscale of the target sub-pixel is adjusted to the second grayscale value a2, the target overdrive compensation voltage ΔL is adjusted to 0, and the controller applies the second pixel voltage L2 to the target sub-pixel, so that the target sub-pixel holds the second grayscale value a2.

In step 209, the overdrive pixel voltage is not determined.

When the controller determines in step 202 that the second grayscale value is equal to the first grayscale value, the controller does not determine the overdrive pixel voltage of the target sub-pixel, that is the controller does not overdrive the target sub-pixel.

A person skilled in the art may easily understand that the sequence of steps of the overdrive method according to the embodiment of the present disclosure can be appropriately adjusted, and the steps can also be correspondingly added or deleted according to the situation. Any method that can be easily conceived by any one skilled in the art within the technical scope disclosed in the present disclosure shall be covered within the protection scope of the present disclosure, and therefore will not be described again.

In summary, in the overdrive method according to the embodiment of the present disclosure, the controller may determine the target overdrive compensation voltage according to the first grayscale value of the first image displayed by the target sub-pixel, the second grayscale value of the second image to be displayed by the target sub-pixel, and the hold duration that the target sub-pixel holds the first grayscale value, and the controller may also apply the overdrive pixel voltage, which is obtained according to the target overdrive compensation voltage, to the target sub-pixel, when the target sub-pixel displays the second image. Since the hold duration which is a parameter that causes the viscosity of the liquid crystal molecule to be enhanced and that the target sub-pixel holds the first grayscale value is taken into consideration during the process of determining the overdrive compensation voltage, applying the overdrive pixel voltage which is obtained according to the target overdrive compensation voltage to the target sub-pixel may help to shorten the response time of the liquid crystal molecules, deflect the liquid crystal molecules to a desired posture in a short time, and improve the display effect of the liquid crystal display panel.

Figure 5:
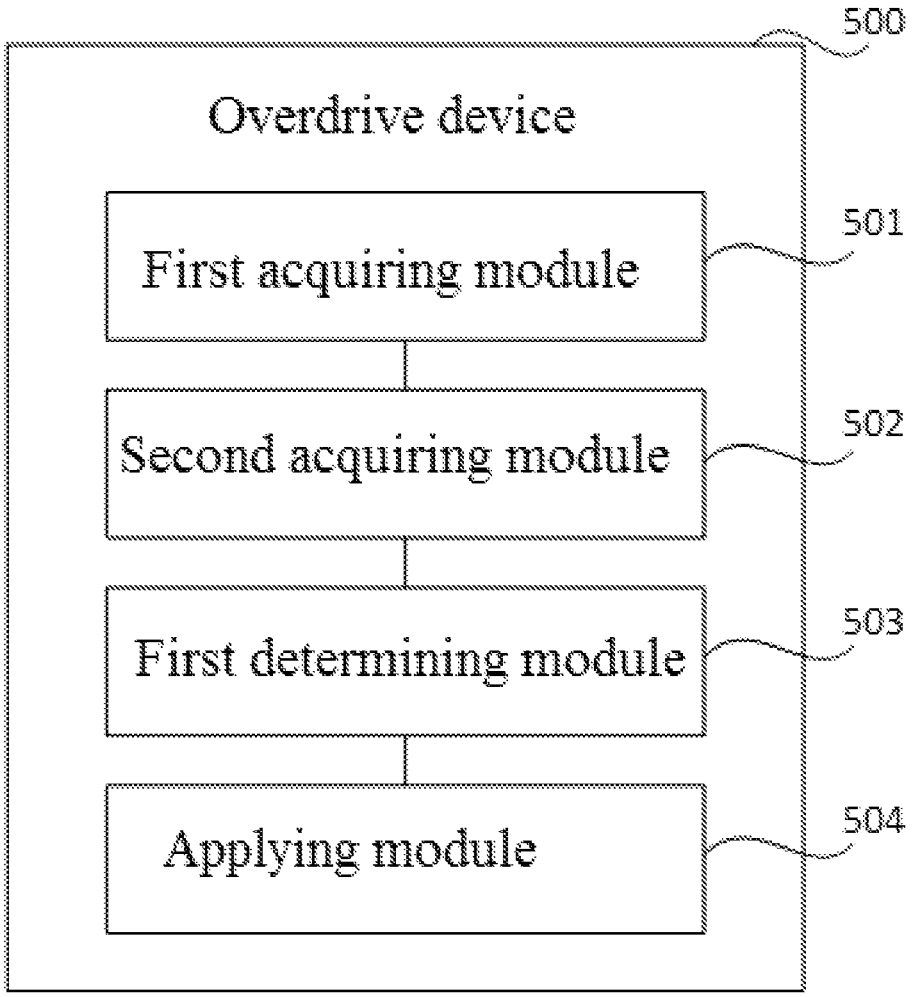
FIG. 5 is a schematic diagram of a structure of an overdrive device according to an embodiment of the present disclosure.

Please refer to FIG. 5, which is a schematic diagram showing a structure of an overdrive device 500 according to an embodiment of the present disclosure. The overdrive device 500 may be used to execute the overdrive method provided by the embodiment shown in FIG. 2 or FIG. 3 and may be a functional unit of the controller 20 in the application environment shown in FIG. 1. Refer to FIG. 5, the overdrive device 500 may include, but is not limited to, a first acquiring module 501, a second acquiring module 502, a first determining module 503, and an applying module 504.

The first acquiring module 501 is configured to acquire a first grayscale value and a second grayscale value, the first grayscale value is a grayscale value of a first image displayed by a target sub-pixel and the second grayscale value is a grayscale of a second image to be displayed by the target sub-pixel.

The second acquiring module 502 is configured to acquire a hold duration that the target sub-pixel holds the first grayscale value in response to that the first grayscale value is not equal to the second grayscale value.

The first determining module 503 is configured to determine a target overdrive compensation voltage according to the first grayscale value, the second grayscale value, and the holding duration.

The applying module 504 is configured to apply an overdrive pixel voltage to the target sub-pixel when the target sub-pixel displays the second image, and the overdrive pixel voltage is obtained according to the target overdrive compensation voltage.

In summary, the overdrive device according to the embodiment of the present disclosure may determine the target overdrive compensation voltage according to the first grayscale value of the first image displayed by the target sub-pixel, the second grayscale value of the second image to be displayed by the target sub-pixel, and the hold duration that the target sub-pixel holds the first grayscale value, and the overdrive device may also apply the overdrive pixel voltage, which is obtained according to the target overdrive compensation voltage, to the target sub-pixel, when the target sub-pixel displays the second image. Since the hold duration which is a parameter that causes the viscosity of the liquid crystal molecule to be enhanced and that the target sub-pixel holds the first grayscale value is taken into consideration during the process of determining the overdrive compensation voltage, applying the overdrive pixel voltage which is obtained according to the target overdrive compensation voltage to the target sub-pixel may help to shorten the response time of the liquid crystal molecules, deflect the liquid crystal molecules to a desired posture in a short time, and improve the display effect of the liquid crystal display panel.

Optionally, the target overdrive compensation voltage is positively correlated with the hold duration.

Optionally, the first determining module 503 is configured to calculate the target overdrive compensation voltage by a target formula according to the first grayscale value, the second grayscale value, and the hold duration. The target formula includes:

$$\Delta L = \frac{t^a}{H} \times \Delta L_{origin};$$

where $\Delta L$ denotes the target overdrive compensation voltage; t denotes the hold duration; $\alpha$ denotes a tuning coefficient of liquid crystal molecules in the target sub-pixel; H denotes a row scanning duration of a liquid crystal display panel where the target sub-pixel is located; $\Delta L_{origin}$ denotes an original overdrive compensation voltage obtained by querying a target correspondence relationship according to the first grayscale value and the second grayscale value. The target correspondence relationship is used to record plural groups of two grayscale values that are adjacent in time sequence and the corresponding overdrive compensation voltages.

Optionally, the first determining module 503 is configured to determine the target overdrive compensation voltage according to the first grayscale value, the second grayscale value, and the hold duration in response to that the hold duration is longer than a single frame display duration. The single frame display duration is a duration that the liquid crystal display panel, where the target sub-pixel is located, displays each frame of an image.

Figure 6:
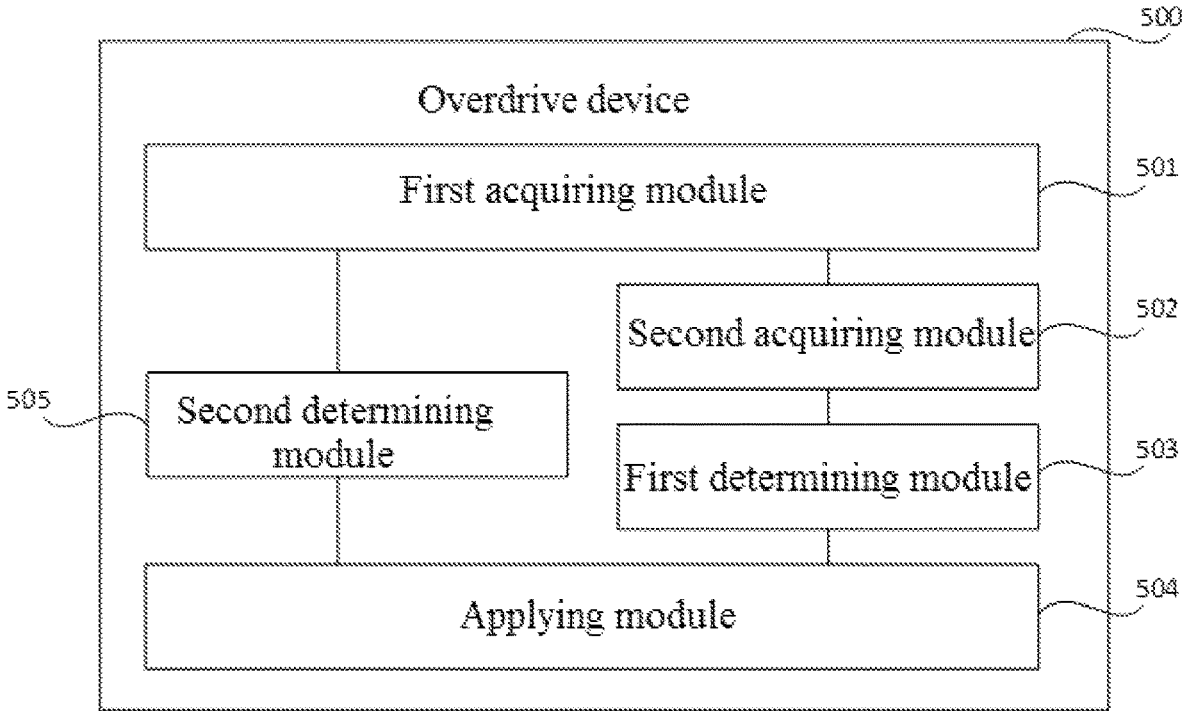
FIG. 6 is a schematic diagram of a structure of another overdrive device according to an embodiment of the present disclosure.

Optionally, please refer to FIG. 6, which is a schematic diagram showing a structure of another overdrive device 500 according to an embodiment of the present disclosure. The overdrive device 500 further includes following modules based on FIG. 5.

A second determining module 505 is configured to:

obtain the original overdrive compensation voltage by querying the target correspondence relationship according to the first grayscale value and the second grayscale value in response to that the hold duration is equal to or shorter than the signal frame display duration. The target correspondence relationship is used to record plural groups of two grayscale values that are adjacent in time sequence and the corresponding overdrive compensation voltages.

The second determining module 505 is also configured to determine the original overdrive compensation voltage as the target overdrive compensation voltage.

Optionally, the applying module 504 is configured to apply the overdrive pixel voltage to the target sub-pixel within a target duration. The target duration is shorter than the single frame display duration, and the single frame display duration is a duration that the liquid crystal display panel where the target sub-pixel is located displays each frame of an image.

Optionally, the target duration is positively correlated with the hold duration.

With regard to the device in the forgoing described embodiments, the specific manner in which the respective modules perform the operations has been described in detail in the embodiments of the method, and will not be explained in detail herein.

Optionally, the first acquiring module 501, the second acquiring module 502, the first determining module 503, the applying module 504, and the second determining module 505 in the embodiment of the present application may all be processing circuits in the TCON IC.

In summary, the overdrive device according to the embodiment of the present disclosure may determine the target overdrive compensation voltage according to the first grayscale value of the first image displayed by the target sub-pixel, the second grayscale value of the second image to be displayed by the target sub-pixel, and the hold duration that the target sub-pixel holds the first grayscale value, and the overdrive device may also apply the overdrive pixel voltage, which is obtained according to the target overdrive compensation voltage, to the target sub-pixel, when the target sub-pixel displays the second image. Since the hold duration which is a parameter that causes the viscosity of the liquid crystal molecule to be enhanced and that the target sub-pixel holds the first grayscale value is taken into consideration during the process of determining the overdrive compensation voltage, applying the overdrive pixel voltage which is obtained according to the target overdrive compensation voltage to the target sub-pixel may help to shorten the response time of the liquid crystal molecules, deflect the liquid crystal molecules to a desired posture in a short time, and improve the display effect of the liquid crystal display panel.

The embodiment of the present application provides a storage medium in which an instruction is stored. When the instruction runs at a processing component, the processing component is actuated to execute the overdrive method according to the embodiments of the present disclosure.

The embodiment of the present application provides a controller of a liquid crystal display panel, which includes the overdrive device as provided in the above embodiments.

The embodiment of the present application provides a display apparatus that includes a liquid crystal display panel and a controller. The controller is the controller of the liquid crystal display panel as provided by the above embodiments, and the controller is configured to execute the overdrive method according to the embodiments of the present application to drive the liquid crystal display panel to display images.

Other embodiments of the present disclosure will be apparent to those skilled in the art from consideration of the specification and practice of the present disclosure. This application is intended to cover any variations, uses, or adaptations of the present disclosure. The variations, uses, or adaptations follow the general principles of the present application and include common knowledge or commonly used technical measures which are not disclosed herein. The specification and embodiments are to be considered as exemplary only, with a true scope and spirit of the present disclosure is indicated by the following claims.

It will be appreciated that the present disclosure is not limited to the exact construction that has been described above and illustrated in the drawings, and that various modifications and changes can be made without departing from the scope thereof. It is intended that the scope of the present disclosure only be limited by the appended claims.

What is claimed is:

1. An overdrive method, comprising:

acquiring a first grayscale value and a second grayscale value, the first grayscale value being a grayscale value of a first image displayed by a target sub-pixel and the second grayscale value being a grayscale of a second image to be displayed by the target sub-pixel;

acquiring a hold duration that the target sub-pixel holds the first grayscale value in response to the first grayscale value being not equal to the second grayscale value;

determining a target overdrive compensation voltage according to the first grayscale value, the second grayscale value, and the hold duration; and applying an overdrive pixel voltage to the target sub-pixel in response to the target sub-pixel displaying the second image, the overdrive pixel voltage being obtained according to the target overdrive compensation voltage;

wherein determining the target overdrive compensation voltage according to the first grayscale value, the second grayscale value, and the hold duration comprises:

calculating the target overdrive compensation voltage by a target formula according to the first grayscale value, the second grayscale value, and the hold duration, the target formula comprising:

$$\Delta L = \frac{t^{\alpha}}{H} \times \Delta L_{origin};$$

wherein ΔL denotes the target overdrive compensation voltage; t denotes the hold duration; α denotes a tuning coefficient of liquid crystal molecules in the target sub-pixel; H denotes a row scanning duration of a liquid crystal display panel where the target sub-pixel is located; ΔLorigin denotes an original overdrive compensation voltage obtained by querying a target correspondence relationship according to the first grayscale value and the second grayscale value, wherein the target correspondence relationship is used to record plural groups of two grayscale values that are adjacent in time sequence and the corresponding overdrive compensation voltages.

2. The overdrive method according to Maim 1, wherein the target overdrive compensation voltage is positively correlated with the hold duration.

3. The overdrive method according to claim 1, wherein determining the target overdrive compensation voltage according to the first grayscale value, the second grayscale value, and the hold duration comprises:

determining the target overdrive compensation voltage according to the first grayscale value, the second grayscale value, and the hold duration in response to the hold duration being longer than a single frame display duration, wherein the single frame display duration is a duration that the liquid crystal display panel, where the target sub-pixel is located, displays each frame of an image.

4. The overdrive method according to claim 3, further comprising:

obtaining an original overdrive compensation voltage by querying the target correspondence relationship according to the first grayscale value and the second grayscale value in response to the hold duration being equal to or shorter than a signal frame display duration, wherein the target correspondence relationship is used to record plural groups of two grayscale values that are adjacent in time sequence and the corresponding overdrive compensation voltages; and determining the original overdrive compensation voltage as the target overdrive compensation voltage.

5. The overdrive method according to claim 1, wherein applying the overdrive pixel voltage to the target sub-pixel comprises:

applying the overdrive pixel voltage to the target sub-pixel within a target duration, wherein the target duration is shorter than a single frame display duration and the single frame display duration is a duration that the liquid crystal display panel, where the target sub-pixel is located, displays each frame of an image.

6. The overdrive method according to claim 5, wherein the target duration is positively correlated with the hold duration.

7. A storage medium in which an instruction is stored, wherein when the instruction runs at a processing component, the processing component is actuated to execute the overdrive method according to claim 1.

8. An overdrive device, comprising:

a first acquiring module, configured to acquire a first grayscale value and a second grayscale value, the first grayscale value being a grayscale value of a first image displayed by a target sub-pixel and the second grayscale value being a grayscale of a second image to be displayed by the target sub-pixel;

a second acquiring module, configured to acquire a hold duration that the target sub-pixel holds the first grayscale value in response to the first grayscale value being not equal to the second grayscale value;

a first determining module, configured to determine a target overdrive compensation voltage according to the first grayscale value, the second grayscale value, and the hold duration; and an applying module, configured to apply an overdrive pixel voltage to the target sub-pixel in response to the target sub-pixel displaying the second image, the overdrive pixel voltage being obtained according to the target overdrive compensation voltage;

wherein the first determining module is configured to calculate the target overdrive compensation voltage by a target formula according to the first grayscale value, the second grayscale value, and the hold duration, the target formula comprising:

$$\Delta L = \frac{t^{\alpha}}{H} \times \Delta L_{origin};$$

wherein ΔL denotes the target overdrive compensation voltage; t denotes the hold duration; α denotes a tuning coefficient of liquid crystal molecules in the target sub-pixel; H denotes a row scanning duration of a liquid crystal display panel where the target sub-pixel is located; ΔLorigin denotes an original overdrive compensation voltage obtained by querying a target correspondence relationship according to the first grayscale value and the second grayscale value, wherein the target correspondence relationship is used to record plural groups of two grayscale values that are adjacent in time sequence and the corresponding overdrive compensation voltages.

9. The overdrive device according to claim 8, wherein the target overdrive compensation voltage is positively correlated with the hold duration.

10. The overdrive device according to claim 8, wherein the first determining module is configured to determine the target overdrive compensation voltage according to the first grayscale value, the second grayscale value, and the hold duration in response to that the hold duration is longer than a single frame display duration, wherein the single frame display duration is a duration that the liquid crystal display panel, where the target sub-pixel is located, displays each frame of an image.

11. The overdrive device according to claim 10, further comprising:

a second determining module, configured to:

obtain the original overdrive compensation voltage by querying the target correspondence relationship according to the first grayscale value and the second grayscale value in response to the hold duration being equal to or shorter than the single frame display duration, wherein the target correspondence relationship is used to record plural groups of two grayscale values that are adjacent in time sequence and the corresponding overdrive compensation voltages; and determine the original overdrive compensation voltage as the target overdrive compensation voltage.

12. The overdrive device according to claim 8, wherein the applying module is configured to apply the overdrive pixel voltage to the target sub-pixel within a target duration, wherein the target duration is shorter than a single frame display duration, and the single frame display duration is a duration that the liquid crystal display panel, where the target sub-pixel is located, displays each frame of an image.

13. The overdrive device according to claim 12, wherein the target duration is positively correlated with the hold duration.

14. A controller of a liquid crystal display panel comprising an overdrive device, the overdrive device comprising:

a first acquiring module, configured to acquire a first grayscale value and a second grayscale value, the first grayscale value being a grayscale value of a first image displayed by a target sub-pixel and the second grayscale value being a grayscale of a second image to be displayed by the target sub-pixel;

a second acquiring module, configured to acquire a hold duration that the target sub-pixel holds the first grayscale value in response to the first grayscale value being not equal to the second grayscale value;

a first determining module, configured to determine a target overdrive compensation voltage according to the first grayscale value, the second grayscale value, and the hold duration; and an applying module, configured to apply an overdrive pixel voltage to the target sub-pixel in response to the target sub-pixel displaying the second image, the overdrive pixel voltage being obtained according to the target overdrive compensation voltage:

wherein the first determining module is configured to calculate the target overdrive compensation voltage by a target formula according to the first grayscale value, the second grayscale value, and the hold duration, the target formula comprising:

$$\Delta L = \frac{t^{\alpha}}{H} \times \Delta L_{origin};$$

wherein ΔL denotes the target overdrive compensation voltage; t denotes the hold duration; α denotes a tuning coefficient of liquid crystal molecules in the target sub-pixel; H denotes a row scanning duration of a liquid crystal display panel where the target sub-pixel is located; ΔLorigin denotes an original overdrive compensation voltage obtained by querying a target correspondence relationship according to the first grayscale value and the second grayscale value, wherein the target correspondence relationship is used to record plural groups of two grayscale values that are adjacent in time sequence and the corresponding overdrive compensation voltages.

15. The controller according to claim 14, wherein the first determining module is configured to determine the target overdrive compensation voltage according to the first grayscale value, the second grayscale value, and the hold duration in response to that the hold duration is longer than a single frame display duration, wherein the single frame display duration is a duration that the liquid crystal display panel where the target sub-pixel is located displays each frame of an image.

16. The controller according to claim 14, wherein the applying module is configured to apply the overdrive pixel voltage to the target sub-pixel within a target duration, wherein the target duration is shorter than a single frame display duration, and the single frame display duration is a duration that the liquid crystal display panel, where the target sub-pixel is located, displays each frame of an image.

17. A display apparatus, comprising a liquid crystal display panel and a controller, wherein the controller is the controller according to claim 14 and configured to drive the liquid crystal display panel to display images.

* * * * *